United States Patent [19]

Tanaka et al.

[11] 4,008,383

[45] Feb. 15, 1977

[54] MICROWAVE OVEN DOOR ASSEMBLY

[75] Inventors: Junzo Tanaka, Fujiidera; Tsuyoshi Takami, Nara; Toshio Kai, Yamatokoriyama, all of Japan

[73] Assignee: Matsushita Electric Industrial Co., Ltd., Osaka, Japan

[22] Filed: Dec. 24, 1974

[21] Appl. No.: 536,095

[30] Foreign Application Priority Data

Dec. 28, 1973 Japan ..... 49-3515

[52] U.S. Cl. ..... 219/10.55 D; 174/35 GC

[51] Int. Cl.[2] ..... H05B 9/06

[58] Field of Search ..... 219/10.55 D, 10.55 F, 219/10.55 R; 174/35 R, 35 GC, 35 MS

[56] References Cited

UNITED STATES PATENTS

| | | | |
|---|---|---|---|
| 2,920,174 | 1/1960 | Haagensen | 219/10.55 D UX |
| 2,958,754 | 11/1960 | Hahn | 219/10.55 D |
| 3,304,401 | 2/1967 | Long | 219/10.55 D |
| 3,305,623 | 2/1967 | Bakker et al. | 174/35 MS |
| 3,431,348 | 3/1969 | Nellis et al. | 219/10.55 D X |
| 3,484,573 | 12/1969 | Tingley | 219/10.55 D |
| 3,633,564 | 1/1972 | Togashi et al. | 219/10.55 D |
| 3,731,035 | 5/1973 | Jarvis et al. | 219/10.55 D |
| 3,843,859 | 10/1974 | Klemp et al. | 219/10.55 D |

*Primary Examiner*—Arthur T. Grimley
*Attorney, Agent, or Firm*—Stevens, Davis, Miller & Mosher

[57] ABSTRACT

A microwave oven whose door screen is constructed by interposing an electromagnetic wave shielding body of a metallic plate having a plurality of through-holes formed therein or a wire screen, between a tempered glass plate and a transparent resin plate, with the tempered glass plate being placed on the side of a heating cavity while the transparent resin plate being placed outwardly, a peripheral section of the shielding body extending to electrically connect with a metal plate which, essentially, electrically connects the heating cavity with the door body, whereby observation of food in the heating cavity during cooking can be facilitated while the safety from electromagnetic wave leakage is assured.

12 Claims, 9 Drawing Figures

MICROWAVE OVEN DOOR ASSEMBLY

The present invention relates to a microwave oven, and more particularly to a structure of a door screen which facilitate the observation of the inside of a heating cavity while assuring safety from electromagnetic wave leakage.

A microwave oven is usually used to dielectrically heat food by a high frequency electromagnetic wave in the order of 2450 MHz, and it usually includes a door for removably closing a front opening of a heating cavity, the door being provided with a door screen to allow the observation of the cooked condition of the food in the heating cavity. Heretofore, in order to reduce the electromagnetic wave leakage from the door screen or to manufacture the door in an economic manner, some of the commercially available microwave ovens included door structures in which a metallic plate constituting a door body was provided with a number of through-holes formed by stamping, on which metallic plate a resin board was overlaid to present the insertion of a metal wire or the like into the heating cavity. Because of stamping, the number of the through-holes in a unit area of the door screen, or opening rate, was limited, which hindered the observation of the inside of the heating cavity. Thus, it has not been possible at all to observe the cooked condition of the food.

While not yet put into practice, a structure comprising a wire screen with heat resisting glass plates being overlaid on either surfaces thereof has been suggested in the U.S. Pat. No. 2,958,754. Such a structure, however, would be expensive because two glass plates should be overlaid and hence it has not been practically used. Another structure comprising a wire screen with transparent resin plates such as acryl plates being overlaid on either surfaces thereof has been suggested in the U.S. Pat. No. 3,431,348, but this structure included a problem in connection with safety. That is, if an article to be heated is burnt owing to the misoperation of the setting of cooking time or failure of a timer, the transparent plastic material may also be burnt. Thus, the structure has also not been practically used.

Furthermore, in the prior art door screen comprising the wire screen and the transparent dielectric material, the mechanical strength of the door screen has mostly relied on the transparent dielectric material since the wire screen had a poor strength. Thus, when a heat resisting glass is used as the transparent dielectric material, the glass plate must have a sufficient thickness, which results in an increase in the cost.

Moreover, in the door screen comprising the wire screen and the transparent dielectric material, the temperature of the door is more or less elevated during the heating operation of the microwave oven. Since the coefficient of thermal expansion of the transparent resin is larger compared with that of glass, it is deformed if the periphery thereof is fixedly secured, resulting in awkward appearance.

In the prior art microwave oven, the inside of the heating cavity is usually not very light although it is illuminated, and normally the illumination of a kitchen is lighter than that in the heating cavity. As a result, when one views the inside of the heating cavity through the door screen, one can hardly see the inside of the heating cavity because the reflected light from a shielding body such as the wire screen obstructs one's field of view. When a wire screen made from fine wires of various materials is used as the shielding material, different reflection factors are presented due to the mismatch of the wire diameter and the material, resulting in various visible patterns, which makes the observation of the inside difficult.

As an approach to overcome the above disadvantages, application of blackpaint has been suggested. In this case, however, since resin paint is applied to the wires of the wire screen, the apparent diameter of the wires increases accordingly and the opening area through which the inside of the heating cavity can be observed decreases, resulting in difficulty of observation.

It is an object of the present invention to provide a microwave oven with a door screen structure which facilitates the observation of the inside of the heating cavity while assuring safety from electromagnetic wave leakage.

It is another object of the present invention to provide a door screen structure which provides sufficient mechanical strength against damage and breakage of the surface thereof, which possesses a high heat resistance and which is cheap in manufacturing cost.

It is another object of the present invention to provide a door screen structure which prevents spark discharge from occuring between a metallic shielding body constituting the door screen and the door body.

According to a preferred embodiment of the present invention, a door screen is formed by laminating an electromagnetic wave shielding body of a metallic plate having a number of through-holes formed therein or a wire screen, between a tempered (or a chemically strengthened) glass plate and a transparent resin plate, with the tempered glass plate being placed on the side of the heating cavity while the transparent resin plate being placed outwardly, the shielding body extending to electrically connect with a metallic plate which, essentially, electrically connects the heating cavity body with the door body.

Since the intermediate shielding body such as the wire screen or etched metal having the tempered glass disposed on the side of the heating cavity and the transparent resin disposed on the front surface is used, it is more economical than that which uses a thick heat resisting glass, and the impact strength of the door screen is enhanced by the tempered glass. Furthermore, since the glass is positioned on the side of the heating cavity, the door would not be burnt even if the article to be heated might be burnt in the heating cavity. In addition, when the door is opened toward the front and if an article is laid on the door screen, the door screen can not be damaged. (When the resin is used, it is apt to be damaged since it does not have sufficient hardness.) Since the tempered glass does not face externally, there exists no risk for damaging the surface of the tempered glass, and a glass of stable strength, both mechanically and thermally, can be provided. When an object collides against the door screen, the structure is such that buffer action can be provided between the object and the tempered glass, and between the tempered glass and a support member. This protects the tempered glass from being broken. Since both sides of the tempered glass are covered, even if the glass is broken, the fragments do not scatter and hence a high degree of safety is assured.

Furthermore, since a good electrical contact between the shielding body and the door structure is kept, discharge phenomenon will not take place even if a certain degree of clearance exists therebetween so that the burn-out of the shielding body may be prevented.

Moreover, the length of a metallic plate for pressing the transparent plate on the side of the heating cavity is restricted so as to eliminate sparks which might otherwise occur at the contact area of the metallic plate and the shield body or to eliminate the breakage of the shield body by the heat.

Further, in the shield body of the present invention the opening areas are not reduced but a black coating is applied in order to improve the observation of the inside of the heating cavity by reflected light.

The above and other objects, features and advantages of the invention will become more apparent from the following detailed description of the preferred embodiments of the present invention when taken in conjunction with the accompanying drawings, in which.

Figure 1:
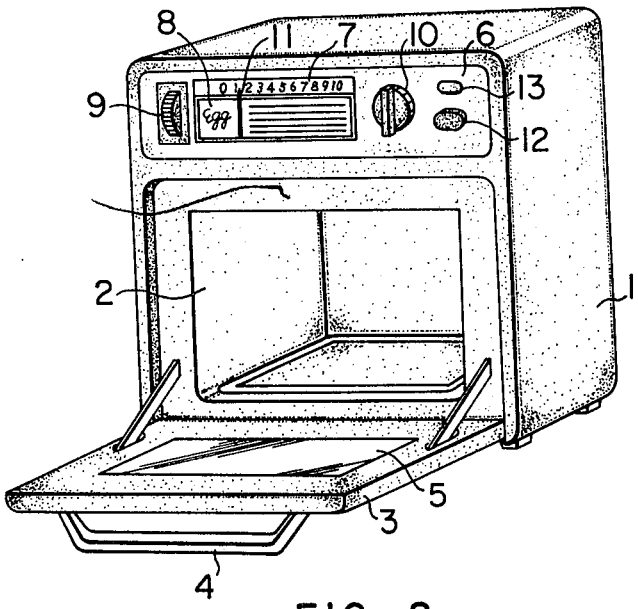
FIG. 1 shows an overall perspective view of a microwave oven with a door thereof held open.
Figure 2:
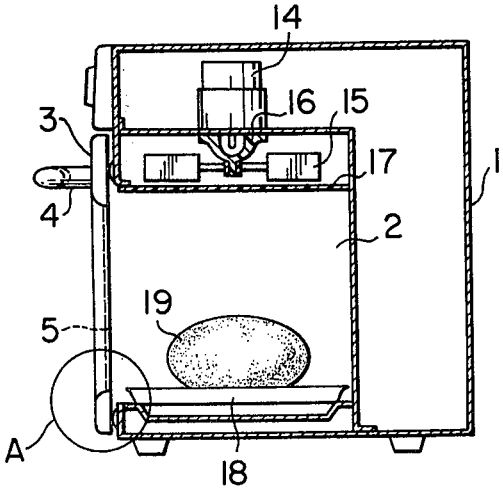
FIG. 2 shows a longitudinal sectional view of the microwave oven.

A microwave oven is usually used to cook food by dielectric heating making use of a high frequency energy in the order of 2450 MHz, and as shown in FIGS. 1 and 2 it comprises an oven body 1 within which a heating cavity 2 is provided, and a door 3 mounted on the oven body 1 and removably closing a front opening of the heating cavity. The door 3 includes a door handle 4 for opening and closing the door 3 and a door screen through which the inside of the heating cavity can be viewed. Formed on a control panel 6 provided on a front top of the oven body 1, at a position corresponding to a time scale plate 7 of a timer, is a scale 8 for setting a heating time appropriate for the amount of food, and for each type of food. By turning a control plate 9 a type of food to be cooked is selected and by turning a timer knob 10 to set a timer indicator needle 11 to the amount of the type of selected food, optimum cooking can be attained. The reference number 12 designates a cooking button and 13 designates a cooking lamp which is turned on while the high frequency wave is being generated.

Mounted on the top of the heating cavity are a magnetron 14 for radiating high frequency energy into the heating cavity, a stirrer vane 15 rotated by the wind used to cool the magnetron, for stirring the high frequency wave in the heating cavity, a stirrer shaft 16 for supporting the stirrer vane 15, a partitioning board 17 for separating the stirrer vane from the cooking cavity and a tray 18 for mounting a cooked article 19.

Figure 3:
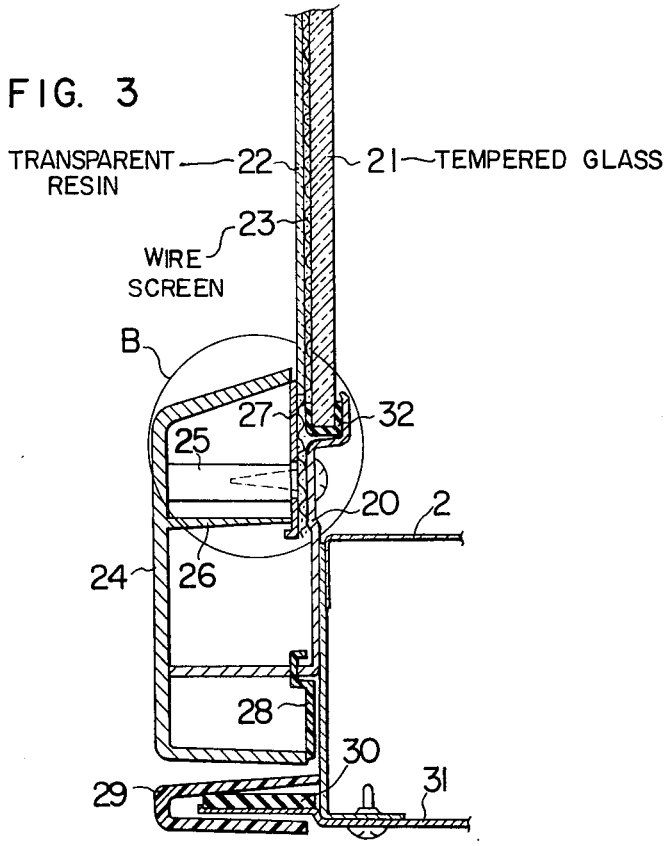
FIG. 3 is an enlarged cross sectional view of the section A shown in FIG. 2.

The present invention will now be described in detail as incorporated in the microwave oven of the above structure. FIG. 3 shows the section A of FIG. 2 in detail, in which the door body comprises a door inner frame 20 of a metallic plate disposed on the side of the heating cavity 2, which metallic plate has been subjected to an insulative coating treatment such as hard almite treatment, a tempered glass 21 forming a door screen, a transparent synthetic resin 22, a wire screen 23 forming a shield body which is free from the leakage of electromagnetic waves, a door body 24 formed by a die of a metal such as zinc, and an abutting plate 27 of metal body provided between the wire screen 23 and an upstanding wall 26 forming a boss 25 for mounting the door body 24 to the door inner frame 20 and a terminating surface of a choke for attenuating an electromagnetic wave. The abutting plate 27 makes surface contact with the wire screen 23 which, in turn, makes surface contact with the door inner frame 20 whereby the leakage of electromagnetic waves is completely prevented.

The reference number 28 designates a resin mold which serves to prevent flakes of the food from entering the electromagnetic wave attenuation choke, and 30 designates a ferrite rubber for attenuating the electromagnetic wave, which is mounted on an edge of an extension projecting forwardly of a botton plate 31 and which is protected by a resin cover 29.

While the wire screen is used as the shield body in the above embodiment, the same explanation may be required when a shield body having a number of throughholes formed by etching process is used.

In the above embodiment the tempered glass was used because it provides much higher impact strength compared with that of a heat resisting glass. The test results for the strength at which the glass was scratched by tableware or the like when used in the microwave oven will now be explained with reference to FIG. 4.

Figure 4:
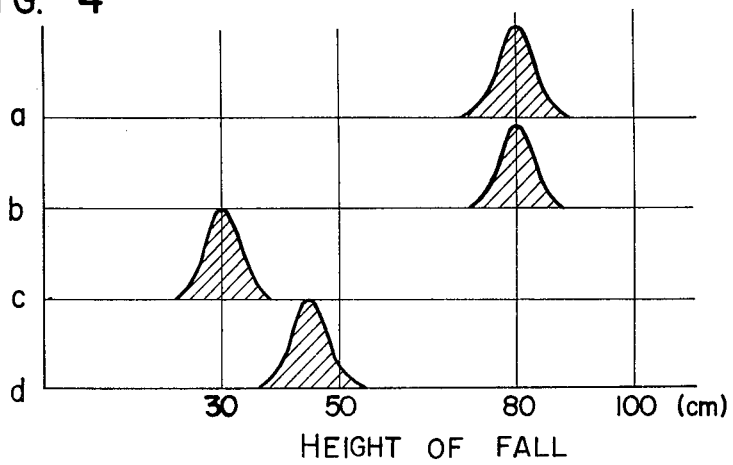
FIG. 4 is a graph illustrating the result of a strength test of a tempered glass.

FIG. 4 shows the distribution of the breakage height for the respective samples where the tempered glass samples of 230 mm length, 3.3 mm thickness and 130 mm width were supported by a pair of wood pieces spaced by 200 mm and a steel ball of 530 g weight was dropped near the center of the glass samples. The distribution of the breakeage height at high values shows that the glass has high strength.

In FIG. 4, the curve *a* shows a strength distribution for a scratch resistant tempered glass, the curve *b* shows strength distribution where the tempered glass has had its one side scratched by being rubbed with a back side of tableware (chinaware), the glass being subjected to the test with the scratched side up, and the curve *c* shows a strength distribution where the tempered glass is scratched in the same manner as *b* above and subjected to a test with the scratched side down.

The scratch was formed on the tempered glass by being scratched with a chinaware cup under the force of approximately 15 kg. The tempered glass has sufficient strength that it is not scratched by placing a small cup with light food thereon in the usual manner. However, the scratch is apt to be formed on the surface of the tempered glass by placing a large cup or vessel on it containing heavy foodstuffs.

It is seen from the data of FIG. 4 that the strength of the tempered glass is little affected by the scratch formed thereon if the impact is applied to the glass from the scratched side. In a microwave oven having a door adapted to be opened to the front, the chance for the tempered glass to be scratched exists when the door is opened and an article is placed thereon or dropped thereon. Thus, the impact to the door glass, if any, would always be applied from the scratched side, and because of the fact that the strength of the tempered glass when it is impacted from the scratched side is substantially equal to the strength for a nonscratched glass a very strong door screen can be provided.

The curve *d* of FIG. 4 shows a strength distribution measured where the glasses of the above type were placed on both sides of the wire screen. It is seen that this structure has a considerably reduced strength compared with the combination of the glass and the resin. When the glasses were bonded to the wire screen by adhesive material, a strength similar to that for the curves *a* and *b* of FIG. 4 was obtained, but this resulted in a considerable increase in costs.

Figure 7:
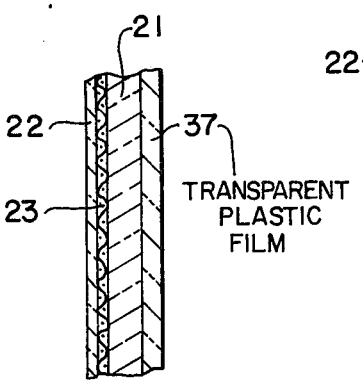
FIGS. 7, 8 and 9 are partially enlarged cross sectional views showing other constructions of a door screen.

A safer product than that illustrated in the above embodiment can be readily provided by covering a side of the tempered glass 21 (FIG. 3) facing to the heating cavity 2 with a transparent plastic material 37 such as a polyester film shown in FIG. 7. The additional transparent plastic film 37 prevents the tempered glass from being scratched and hence prevents degradation of the strength of the glass.

In the embodiment illustrated in FIG. 3, in order to further enhance the strength of the tempered glass 21, a U-shaped resilient member 32 such as silicon rubber is wrapped around the edges of the tempered glass 21, the resilient member 32 being sandwiched between the tempered glass 21 and the door inner frame 20.

As stated above, when the tempered glasses are placed on both sides of the wire screen the impact strength decreases compared with that of a single glass structure. The reason for this decrease can be explained as follows:

In the single glass structure, the impact force may escape through deflection so that a high strength can be presented. In a dual glass structure, however, since the periods of the deflections for both glasses upon being impacted are mismatched, there occurs an impact between the two glasses and the lower glass restricts the deflection of the upper glass. As a result, the impact force will be concentrated at the impacting point so that the upper glass may be readily destroyed. When the two tempered glasses are bound together by adhesive material to form a composite glass, it posses a strength similar to that of the single glass structure because an intermediate layer functions as a cushion. However, if the bonding is not complete, the force withstanding the impact force decreases accordingly. It is thus seen from the above consideration that the door screen of the present invention is economical and has a high impact strength.

Figure 5:
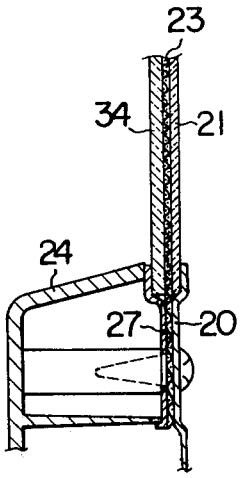
FIG. 5 shows a cross sectional view of a modification of the section B shown in FIG. 3.

FIG. 5 shows an enlarged cross sectional view of a modification of the section B shown in FIG. 3, in which either the wire screen 23 or the door inner frame 20 is subjected to insulation treatment to prevent the discharge from taking place even if there exists an incomplete contact to some degree.

Figure 6:
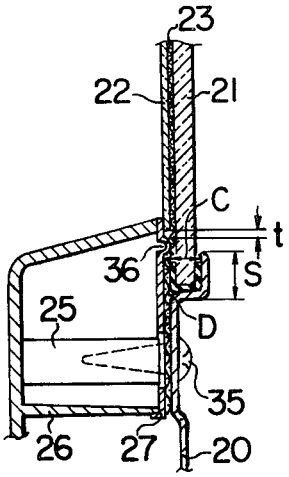
FIG. 6 shows a cross sectional view of a further modification of the section B shown in FIG. 3.

FIG. 6 shows another modification of the section B shown in FIG. 3, in which a stamped hole for a bolt in the abutment 27 is designed to have a larger dimension than a diameter of a boss 25 for fixing the door inner frame so that as a bolt 35 is tightened the abutment 27 of metal plate is pressed on the upstanding wall 26 of the door body. In addition, the abutment 27 is formed with a projection 36 which extends beyond the thickness of the transparent synthetic resin 22, and a clearance *t* is provided between the end of the resin 22 and the projection 36 so as to allow expansion and the shrinkage of the end of the transparent resin.

Furthermore, the dimension S of the door inner frame 20 which retains the door screen is described. The dimension S shown in FIG. 6 and the thickness of the transparent plate electrically constitute a choke. It has been proved by experiment that the section C is the maximum electric field and minimum current area and the point D is the minimum electric field and maximum current area, and that heat is generated at the point D by shortcircuited current and the wire screen there may be burnt out, from which electromagnetic waves leak externally. It has also been confirmed by the experiment that the above difficulty can be resolved if the dimension S is set at or below 17 mm. Theoretically, the worst choke structure, that is, the maximum current at the point D, would occur when the dimension S were $\lambda/4$ or approximately 30 mm, but in actuality the worst choke dimension S is smaller than $\lambda/4$ because the glass is inserted in the choke. Accordingly, the dimension S is selected so as not to correspond to odd number multiples of $\lambda/4$. Since the experiment was carried out in a completely vacant condition without any tray or the like in order to save experimental time, a defect occured in a short time. In practical use, however, since the electromagnetic wave is radiated while an article to be heated is inserted, the structure can remain serviceable for several tens of times as long as the illustrated time period. The result of the experiment is given below:

| Radiation period | Dimension S | | | | |
|---|---|---|---|---|---|
| | 10 mm | 13.5 mm | 17 mm | 20 mm | 25 mm |
| 30 min. | ◎ | ◎ | ○ | X | X |
| 5 hrs. | ◎ | ◎ | Δ | XX | XX |
| 10 hrs. | ◎ | ◎ | X | XX | XX |

◎ No appreciable change.
○ Slight change in color observed.
Δ Partial change in color observed.
X Substantial change in color observed or a hole by spark in the order of 1 mm in diameter formed.
XX Several holes formed by sparks in the order of 1 – 5 mm in diameter formed.

Figure 8:
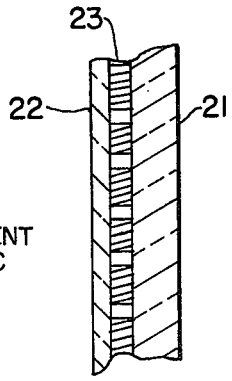
Figure 9:
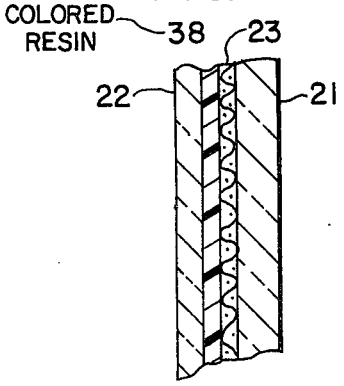

Finally, a method for reducing the reflection of light from the wire mesh or the etched metal (FIG. 8) having a number of through-holes formed therein is described.

a. When a wire screen of stainless wires of small diameter is used:

A dark wire screen can be provided by plating black nickel. (In this case it exhibits conductivity.)

b. When a wire screen of aluminum wires of small diameter is used:

The aluminum wires are subjected to alumite treatment, and black paint is inserted into bores formed during the alumite treatment and then bores are sealed to produce a black wire screen. (An insulated coating is formed.)

c. When an etched stainless is used:

The same treatment as mentioned in (a) is also applicable. Alternatively, the surface thereof is roughened to the roughness of 0.81 $\mu$ or more. Since the wavelength of the visible light lies in the range of 0.38 $\mu$ to 0.81 $\mu$, when the surface of the metal has the roughness greater than the above range, the light is reflected in every direction so that observation is facilitated.

d. In addition to the stainless screen or the etched metal of (c), when a colored resin board 38 is overlaid on the front of the transparent plate as shown in FIG. 9, the observation is further facilitated.

What we claim is :

1. In a microwave oven having a heating cavity and means for radiating microwave energy into said heating cavity, a door assembly mounted on said oven for opening and closing access to said heating cavity, comprising:

a door screen formed in said door and comprising an exterior transparent resin plate, an interior strengthened glass plate interposed between said resin plate and said heating cavity, and a shielding body of a wire screen or metal plate having a number of through-holes formed therein laminated between said resin and strengthened glass plates, said resin plate being mounted to permit free expansion and contraction of its peripheral edges;

a peripheral door body, an inner door frame having an L-shaped portion to which said strengthened glass is secured and having a leg substantially parallel to the upstanding leg of said L-shaped portion, and an abutting metal plate in contact with the inner side of said door body and facing said substantially parallel leg of said inner door frame;

wherein said shielding body extends peripherally beyond the edges of said strengthened glass plate, said peripherally extending portion of said shielding body being sandwiched between said substantially parallel leg of said inner door frame and said adjacent abutting plate, said peripherally extending portion of said shielding body electrically contacting said abutting plate to prevent leakage of electro-magnetic energy from said heating cavity through said shielding body.

2. The microwave oven door assembly according to claim 1, wherein an outer surface of said strengthened glass plate facing said heating cavity is covered with a transparent plastic material.

3. The microwave oven door assembly according to claim 1, wherein said peripherally extending portion of said shielding body and said substantially parallel leg of said inner door frame are insulated from each other to prevent electrical discharge therebetween.

4. The microwave oven door assembly according to claim 1, further comprising a U-shaped member seated on said L-shaped portion of said inner door frame, said U-shaped member receiving and securing the periphery of said strengthened glass plate.

5. The microwave oven door assembly according to claim 1, wherein said shielding body is made of stainless steel and has black nickel plating applied to its surface.

6. The microwave oven door assembly according to claim 1, wherein said shielding body is made of stainless steel and is constructed of an etched metal having a surface roughness of 0.81 $\mu$ or more.

7. The microwave oven door assembly according to claim 1, wherein said shielding body is made of stainless steel and has a colored resin board overlaid on the front thereof.

8. The microwave oven door assembly according to claim 1, wherein said door body has a mounting boss and an upstanding wall forming a terminating surface of a choke for attenuating a leaking electromagnetic wave, and said abutting plate is sandwiched between said shielding body and said upstanding wall.

9. The microwave oven door assembly according to claim 8, further comprising a bolt hole located in said abutting plate in correspondence with said mounting boss, wherein the diameter of said bolt hole in said abutting plate is larger than the diameter of said mounting boss.

10. The microwave oven door assembly according to claim 1, wherein the length of the upstanding leg of the L-shaped portion of said inner door frame is selected to be other than a substantially odd numbered multiple of ¼ $\lambda$, where $\lambda$ is the wavelength of the nominal frequency generated by said microwave energy radiating means.

11. A microwave oven according to claim 1, wherein said electromagnetic shielding body is treated with insulation to prevent discharge between said shielding body and said door body and said inner frame door.

12. The microwave oven door assembly according to claim 11, wherein said shielding body is made of aluminum subjected to an alumite surface treatment with black paint.

* * * * *